US008246005B2

(12) United States Patent
Sakai et al.

(10) Patent No.: US 8,246,005 B2
(45) Date of Patent: Aug. 21, 2012

(54) ELECTROMAGNETIC FUEL INJECTION VALVE AND METHOD OF MANUFACTURING THE SAME

(75) Inventors: Toshikazu Sakai, Kakuda (JP); Ryuji Aoki, Miyagi (JP)

(73) Assignee: Keihin Corporation, Tokyo (JP)

( * ) Notice: Subject to any disclaimer, the term of this patent is extended or adjusted under 35 U.S.C. 154(b) by 526 days.

(21) Appl. No.: 12/488,222

(22) Filed: Jun. 19, 2009

(65) Prior Publication Data

US 2010/0001214 A1 Jan. 7, 2010

(30) Foreign Application Priority Data

Jul. 7, 2008 (JP) ..... 2008-177056

(51) Int. Cl.
*F16K 31/02* (2006.01)

(52) U.S. Cl. ..... 251/129.21; 239/585.4; 228/49.3

(58) Field of Classification Search ..... 228/44.3, 228/44.5, 47.1; 239/585.1, 585.4; 251/129.15, 251/129.21; 269/20, 21, 24; 29/890.129, 29/829.131

See application file for complete search history.

(56) References Cited

U.S. PATENT DOCUMENTS 2,991,347 A * 7/1961 Weinstein ..... 219/85.16
5,178,362 A * 1/1993 Vogt et al. ..... 251/129.21
5,232,166 A * 8/1993 Reiter ..... 239/585.4
5,431,331 A * 7/1995 Ney et al. ..... 228/212
5,716,009 A * 2/1998 Ogihara et al. ..... 239/533.12
6,758,420 B2 * 7/2004 Arioka et al. ..... 239/585.4
7,926,781 B2 * 4/2011 Wang ..... 248/685
2002/0047054 A1 * 4/2002 Dallmeyer et al. ..... 239/585.1
2003/0230649 A1 * 12/2003 Nagaoka et al. ..... 239/585.1
2007/0272773 A1 * 11/2007 Akabane ..... 239/585.1

FOREIGN PATENT DOCUMENTS

JP 363235068 A * 9/1988
JP 3819907 B2 6/2006

* cited by examiner

*Primary Examiner* — John Fristoe, Jr.
*Assistant Examiner* — R. K. Arundale
(74) *Attorney, Agent, or Firm* — Arent Fox LLP

(57) ABSTRACT

In an electromagnetic fuel injection valve in which: a suction tubular part projecting toward an inside of a nonmagnetic cylindrical body is provided to a front end portion of a stationary core; and a front end of the suction tubular part and a rear end of a movable core are opposed to each other in the inside of the nonmagnetic cylindrical body, an annular gap allowing influx of pressure fluid used for a check of liquid-tightness between the nonmagnetic cylindrical body and the stationary core is provided between an outer peripheral surface of the suction tubular part and an inner peripheral surface of the nonmagnetic cylindrical body. Accordingly, it enables a quick and efficient judgment to be made on a check on liquid-tightness of a welded part by applying fluid pressure to the inside of the valve housing after the valve housing of the electromagnetic fuel injection valve is produced.

3 Claims, 3 Drawing Sheets

ELECTROMAGNETIC FUEL INJECTION VALVE AND METHOD OF MANUFACTURING THE SAME

CROSS-REFERENCE TO RELATED APPLICATION

This application claims priority from Japanese Application No.: 2008-177056, filed Jul. 7, 2008, the disclosure of which is hereby incorporated in its entirety by reference.

BACKGROUND OF THE INVENTION

1. Field of the Invention

The present invention relates to an improvement of an electromagnetic fuel injection valve, in which a valve housing includes: a tubular valve seat member having a valve seat in a front end portion thereof; a magnetic cylindrical body coaxially connected to a rear end portion of the valve seat member; a nonmagnetic cylindrical body coaxially and liquid-tightly welded to a rear end of the magnetic cylindrical body; and a hollow cylindrical stationary core coaxially and liquid-tightly welded to a rear end of the nonmagnetic cylindrical body, a valve assembly is housed in the valve housing and includes: a valve body capable of being seated on the valve seat; and a movable core connected to a rear end of the valve body, a suction tubular part projecting toward an inside of the nonmagnetic cylindrical body is provided to a front end portion of the stationary core, and a front end of the suction tubular part and a rear end of the movable core are opposed to each other in the inside of the nonmagnetic cylindrical body, and a method of manufacturing the same.

2. Description of the Related Art

Such an electromagnetic fuel injection valve is known from the Japanese Patent No. 3819907.

The axial dimension of such an electromagnetic fuel injection valve can be decreased by opposing the front end of the suction tubular part of the stationary core and the rear end of the movable core to each other inside the nonmagnetic cylindrical body.

When such an electromagnetic fuel injection valve is manufactured, a valve housing is produced by coaxially welding the valve seat member, the magnetic cylindrical body, the nonmagnetic cylindrical body and the stationary core sequentially. After the valve housing is completed, it is checked whether or not each welded part is satisfactorily liquid-tight. In this check, a fluid pressure is applied to the inside of the valve housing. Thereby, whether or not each welded part is satisfactorily liquid-tight is judged depending on whether or not pressure leaks from each welded part.

However, in the conventional type of electromagnetic fuel injection valve, as disclosed in Japanese Patent No. 3819907, the stationary core is temporarily fixed to the nonmagnetic cylindrical body by press-fitting the suction tubular part of the stationary core into the inner peripheral surface of the nonmagnetic cylindrical body in a step preceding a step of welding the nonmagnetic cylindrical body and the stationary core together. As a result, at the time of a liquid-tightness checking, it takes a considerable time for the fluid pressure to reach the welded part after passing the press-fitted portion, and therefore takes a long time to check whether or not pressure leaks from the welded part. This deteriorates the checking efficiency.

SUMMARY OF THE INVENTION

With this situation taken into consideration, the present invention has been made. An object of the present invention is to provide an electromagnetic fuel injection valve and a method of manufacturing the same, both of which enables a quick and efficient judgment to be made on the check on the liquid-tightness of the welded part by applying fluid pressure to the inside of the valve housing after the valve housing is produced.

In order to achieve the above-described object, according to a first feature of the present invention, there is provided an electromagnetic fuel injection valve, in which a valve housing includes: a tubular valve seat member having a valve seat in a front end portion thereof; a magnetic cylindrical body coaxially connected to a rear end portion of the valve seat member; a nonmagnetic cylindrical body coaxially and liquid-tightly welded to a rear end of the magnetic cylindrical body; and a hollow cylindrical stationary core coaxially and liquid-tightly welded to a rear end of the nonmagnetic cylindrical body, a valve assembly is housed in the valve housing and includes: a valve body capable of being seated on the valve seat; and a movable core connected to a rear end of the valve body, a suction tubular part projecting toward an inside of the nonmagnetic cylindrical body is provided to a front end portion of the stationary core, and a front end of the suction tubular part and a rear end of the movable core are opposed to each other in the inside of the nonmagnetic cylindrical body, wherein an annular gap is provided between an outer peripheral surface of the suction tubular part and an inner peripheral surface of the nonmagnetic cylindrical body, the annular gap allowing influx of a pressure fluid used for a check of liquid-tightness between the nonmagnetic cylindrical body and the stationary core.

According to the first feature of the present invention, when a high-pressure fluid is supplied to the inside of the valve housing to check the liquid-tightness of each welded part in the valve housing after the production of the valve housing, the fluid smoothly can enter the inside, particularly the annular gap between the suction tubular part of the stationary core and the nonmagnetic cylindrical body, and thus can quickly reach the welded part between the nonmagnetic cylindrical body and the stationary core. Consequently, it is possible to check whether or not the fluid leaks from the welded part almost simultaneously with the supply of the fluid. Thus, whether or not the welded part is satisfactorily liquid-tight can be judged based on the presence of the fluid leak. This can greatly speed up the liquid-tightness checking process. Furthermore, because the movable core and the suction tubular part of the stationary core are disposed so as to be opposed to each other in the inside of the nonmagnetic cylindrical body, the electromagnetic fuel injection valve is made capable of maintaining the advantage of the reduced axial dimension of the electromagnetic fuel injection valve as in the case of the prior art.

According to a second feature of the present invention, there is provided a method of manufacturing an electromagnetic fuel injection valve, wherein, in welding the magnetic cylindrical body, the nonmagnetic cylindrical body and the stationary core of the electromagnetic fuel injection valve according to the first feature, a jig made by coaxially connecting a large-diameter shaft part and a small-diameter shaft part together is prepared, the large-diameter shaft part being capable of being tightly fitted into inner peripheral surfaces respectively of the magnetic cylindrical body and the nonmagnetic cylindrical body, the small-diameter shaft part being capable of being tightly fitted into an inner peripheral surface of the stationary core, and then an axial meeting part between the magnetic cylindrical body and the nonmagnetic cylindrical body as well as an axial meeting part between the nonmagnetic cylindrical body and the stationary core are welded in a state where the inner peripheral surfaces respectively of the magnetic cylindrical body and the nonmagnetic cylindrical body are tightly fitted onto an outer peripheral surface of the large-diameter shaft part of the jig, and where the inner peripheral surface of the stationary core is tightly fitted onto an outer peripheral surface of the small-diameter shaft part.

According to the second feature of the present invention, the magnetic cylindrical body, the nonmagnetic cylindrical body and the stationary core can be liquid-tightly connected with high coaxial accuracy, and concurrently the annular gap having a constant clearance throughout its entire periphery can be formed between the nonmagnetic cylindrical body and the suction tubular part.

According to a third feature of the present invention, in addition to the second feature, tapered surfaces are respectively formed in inner peripheral edge portions of two axial ends of the nonmagnetic cylindrical body, the tapered surfaces being capable of guiding the large-diameter shaft part so that the large-diameter shaft part is tightly fitted into an inside of the nonmagnetic cylindrical body.

According to the third feature of the present invention, the large-diameter shaft part of the jig can be tightly fitted into the inside of the nonmagnetic cylindrical body in a smooth manner with the aid of the guidance of the tapered surface of the inner periphery of an end of the nonmagnetic cylindrical body. Accordingly, it is possible to set the nonmagnetic cylindrical body onto the jig easily and quickly. Furthermore, because the tapered surface is provided to the two end portions of the nonmagnetic cylindrical body, it is possible to further increase ease with which the nonmagnetic cylindrical body is set onto the jig, no matter which direction the two ends of the nonmagnetic cylindrical body face. Concurrently, the tapered surface of the inner periphery of the other end of the nonmagnetic cylindrical body is capable of receiving the fillet around the base end of the suction tubular part in its inside. Accordingly, it is possible to form the fillet as a thicker member, and thus to increase the strength of the base end of the suction tubular part.

An embodiment of the present invention will be explained below by reference to the attached drawings.

DESCRIPTION OF THE PREFERRED EMBODIMENT

Figure 1:
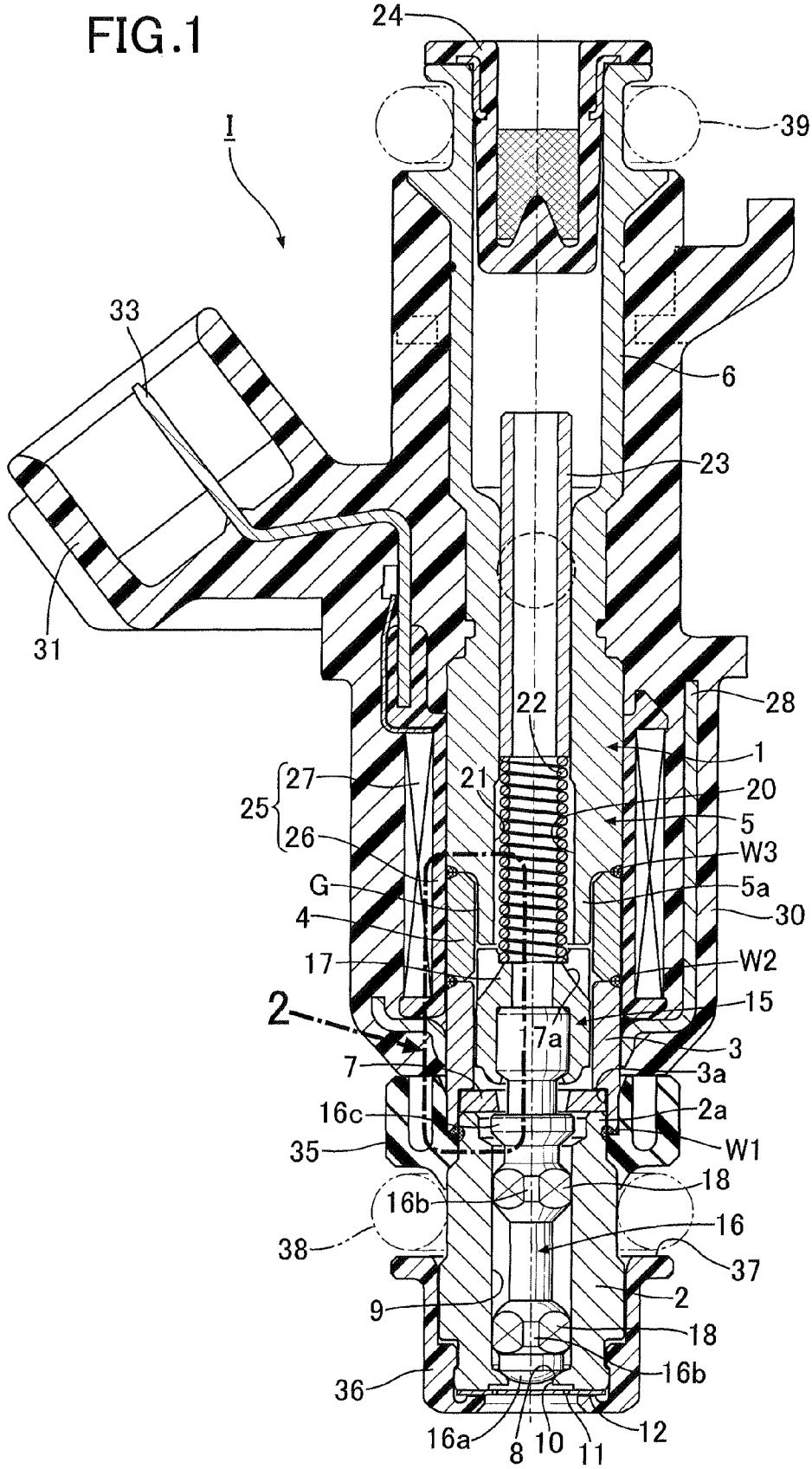
FIG. 1 is a vertical cross-sectional view of an electromagnetic fuel injection valve for an internal combustion engine according to an embodiment of the present invention.
Figure 2:
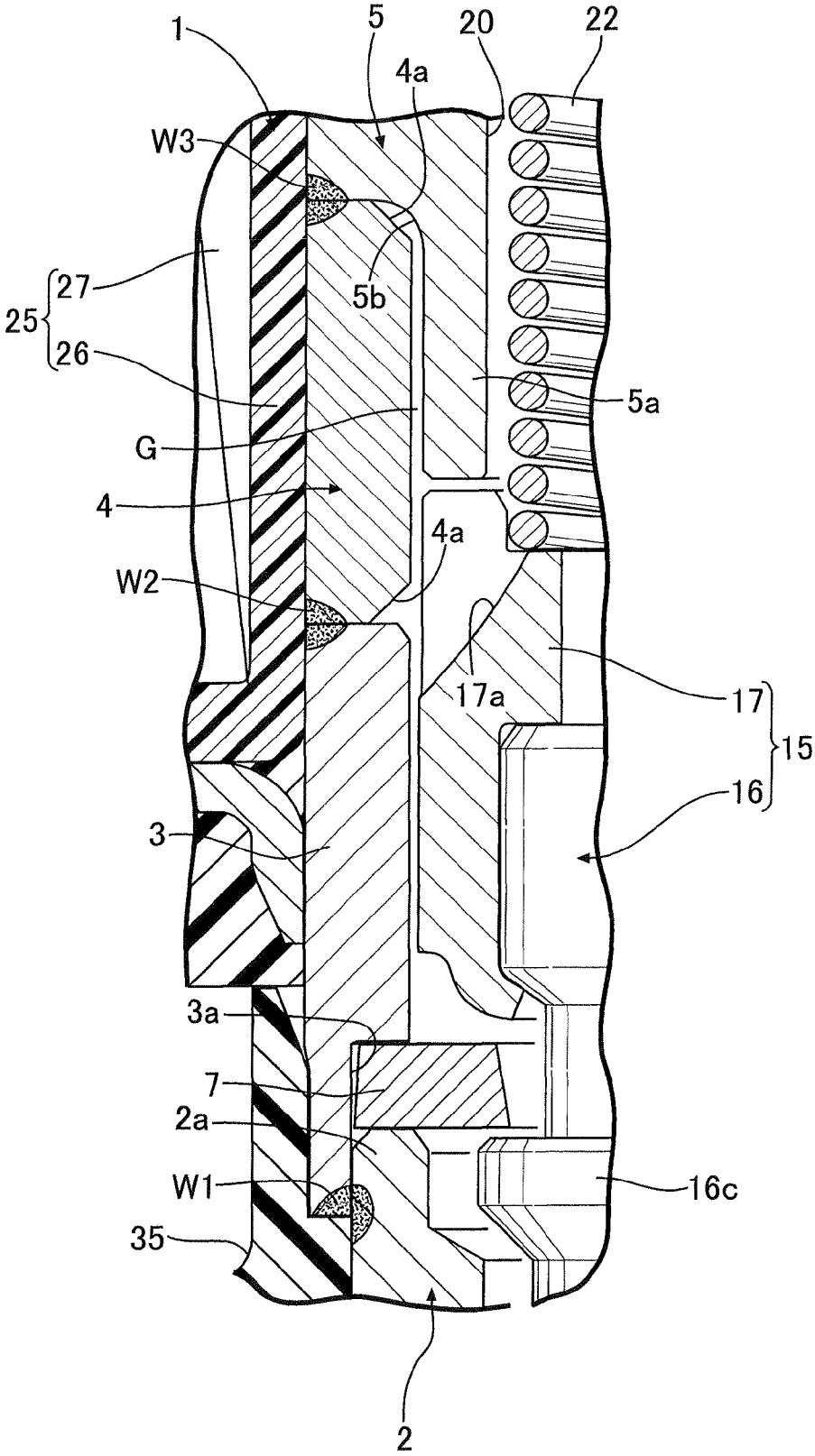
FIG. 2 is an enlarged view of a part 2 in FIG. 1.

First, in FIGS. 1 and 2, a valve housing 1 of an electromagnetic fuel injection valve I includes a cylindrical valve seat member 2, a magnetic cylindrical body 3 coaxially connected to a rear end portion of the valve seat member 2 with a C-shaped stopper plate 7 interposed therebetween, a nonmagnetic cylindrical body 4 coaxially connected to a rear end of the magnetic cylindrical body 3, a hollow cylindrical stationary core 5 coaxially connected to a rear end of the nonmagnetic cylindrical body 4, and a fuel inlet tube 6 coaxially and continuously provided to a rear end of the stationary core 5.

As shown in FIGS. 1 and 2, the valve seat member 2 has a connecting tube part 2*a*, which has a reduced diameter, at its rear end portion, and the magnetic cylindrical body 3 has an annular recess part 3*a* at an inner periphery of its front end portion. The connecting tube part 2*a* is press-fitted into the annular recess part 3*a*. Here, the stopper plate 7 is sandwiched between an inner end face of the annular recess part 3*a* and an end face of the connecting tube part 2*a*. A front end face of the magnetic cylindrical body 3 is connected by laser welding to the connecting tube part 2*a* over the entire periphery (the welded part is denoted by reference numeral W1). In this way, the valve seat member 2 and the magnetic cylindrical body 3 are coaxially and liquid-tightly connected to each other.

Further, the magnetic cylindrical body 3 and the nonmagnetic cylindrical body 4 are coaxially and liquid-tightly connected together by laser welding over their entire peripheries at mutually abutting end surfaces thereof (the welded part is denoted by reference numeral W2). These magnetic cylindrical body 3 and nonmagnetic cylindrical body 4 are disposed so as to make their inner peripheral surfaces and outer peripheral surfaces continuous and flush with each other by equalizing their inner and outer diameters. Tapered surfaces 4*a*, 4*a* are formed on inner peripheral edge portions at axially opposite ends of the nonmagnetic cylindrical body 4.

Further, the nonmagnetic cylindrical body 4 and the stationary core 5 are coaxially and liquid-tightly connected together by laser welding over their entire peripheries at mutually abutting end surfaces thereof (the welded portion is denoted by reference numeral W3). A suction tubular part 5*a* jutting out into the inside of the nonmagnetic cylindrical body 4 is formed in the stationary core 5. An annular gap G is provided between the outer peripheral surface of this suction tubular part 5*a* and the inner peripheral surface of the nonmagnetic cylindrical body 4. The annular gap G is set up so that a pressurized fluid used to check the liquid-tightness of the welded portion W3 can enter the annular gap G smoothly, and so that the suction capability of the suction tubular part 5*a* can be satisfied. A fillet 5*b* is formed in the base end portion of the suction tubular part 5*a*. This fillet 5*a* is placed inward of the tapered surface 4*a* of the inner peripheral edge of the rear end portion of the nonmagnetic cylindrical body 4.

The valve seat member 2 is formed with a conical valve seat 8 having a downstream end opened at a front end face of the valve seat member, a cylindrical guide hole 9 leading to an upstream end, that is, a large-diameter part of the valve seat 8, and a valve hole 10 passing through the center part of the valve seat 8. An injector plate 12 having one or a plurality of fuel injection holes 11 communicating with the valve hole 10 is liquid-tightly welded to the front end of the valve seat member 2.

The valve assembly 15 is housed in the valve housing 1. The valve assembly 15 comprises a valve body 16 housed in an axially slidable manner in the guide hole 9, and a movable core 17 integrally connected by crimping to the rear end part of the valve body 16. The valve assembly 15 is arranged so that a rear end of the movable core 17 and a front end of the suction tubular part 5*a* of the stationary core 5 are opposed to each other within the nonmagnetic cylindrical body 4. A plurality of cutouts 17*a* communicating a hollow part 20 of the stationary core 5 with both inner sides of the magnetic cylindrical body 3 and the nonmagnetic cylindrical body 4 are formed in the rear end of the movable core 17.

The valve body 16 is integrally provided with a spherical valve part 16*a* capable of being seated on the valve seat 8, a pair of front and rear journal parts 16*b*, 16*b* slidably supported by the guide hole 9, and a flange 16*c* abutting against the stopper plate 7 and defining the open limit of the valve body 16. Each of the journal parts 16*b* is provided with a plurality of chamfered parts 18 allowing passing of the fuel.

A coil-shaped valve spring 22 urging the movable core 17 in a closing direction of the valve body 16, that is, in a direction to seat on the valve seat 8, and a pipe-shaped retainer 23 supporting a rear end of the valve spring 22 are housed in the hollow part 20 of the stationary core 5. A fuel filter 24 is installed in an inlet of the fuel inlet tube 6.

A coil assembly 25 is fitted around outer peripheries of the magnetic cylindrical body 3 and the stationary core 5. The coil assembly 25 comprises a bobbin 26 fitted around outer peripheral surfaces of the magnetic cylindrical body 3 and the stationary core 5, and a coil 27 wound around the bobbin 26. A coil housing 28 surrounding the coil assembly 25 is connected at one end portion thereof by welding to the outer peripheral surface of the magnetic cylindrical body 3.

The coil housing 28, the coil assembly 25 and the stationary core 5 are embedded inside a covering member 30 made of a synthetic resin, and a coupler 31 housing a connecting terminal 33 leading to the coil 27 is integrally and continuously provided in an intermediate portion of the covering member 30.

An annular seal holder 35 stretches and is fitted to the outer peripheries of a portion of the magnetic cylindrical body 3 and a portion of the valve seat member 2. An annular groove 37 is formed between this seal holder 35 and a cap 36 fitted to the front end portion of the valve seat member 2. The cap 36 is made of a synthetic resin. An O-ring 38 configured to be in tight contact with the outer peripheral surface of the valve seat member 2 is attached to this annular groove 37. When the electromagnetic fuel injection valve I is installed into a fuel injection valve installation hole (not illustrated) formed in an engine, this O-ring 38 is configured to be in tight contact with the inner peripheral surface of the installation hole.

Another O-ring 39 is attached to the outer periphery of the inlet portion of the fuel inlet tube 6. This O-ring 39 is configured to be in tight contact with the inner peripheral surface of a fuel distribution pipe (not illustrated) fitted to the outer periphery of the fuel inlet tube 6.

Accordingly, in a state where the coil 27 is being demagnetized, the movable core 17 and the valve body 16 are pressed forward by the biasing force of the valve spring 22, and the valve part 16*a* is seated on the valve seat 8. Consequently, the high-pressure fuel having supplied to the fuel inlet tube 6 is filled into the insides respectively of the stationary core 5, the nonmagnetic cylindrical body 4, the magnetic cylindrical body 3 and the valve seat member 2, and thereafter waits for the valve hole to be open.

Once the coil 27 is electrically connected, the magnetic flux produced by the electricity sequentially passes the stationary core 5, the coil housing 28, the magnetic cylindrical body 3 and the movable core 17. Thus, the movable core 17 is sucked to the suction tubular part Sa of the stationary core 5 due to the magnetic force. Consequently, the valve body 16 configured to move together with this movable core 17 is separated away from the valve seat 8, and the valve hole 10 is opened. For this reason, the high-pressure fuel inside the valve seat member 3 goes through the chamfered parts 18 of the valve body 16, and then the valve seat 8 and the valve hole 10. Thereafter, the high-pressure fuel is injected from the fuel injection holes 11 to an intake port (not illustrated) of an internal combustion engine. While the fuel is being injected, the flange 16*c* of the valve body 16 is caught by the stopper plate 7, and the opening valve stroke is accordingly restricted to be within a certain range.

Figure 3:
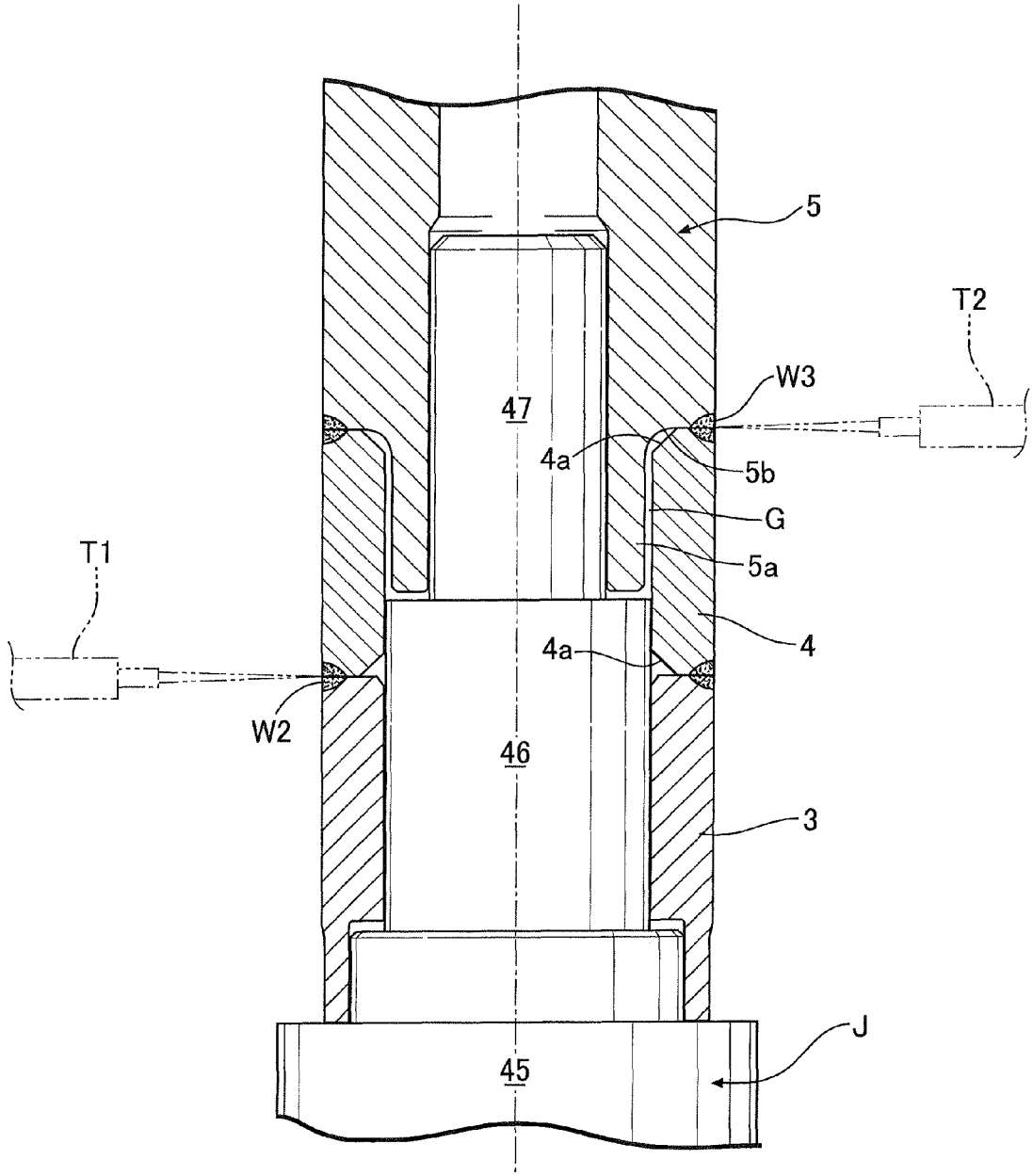
FIG. 3 is a view explaining a welding step with a part of a valve housing of the electromagnetic fuel injection valve shown.

Next, referring to FIG. 3, descriptions will be provided for particularly a step of coaxially connecting the magnetic cylindrical body 3, the nonmagnetic cylindrical body 4 and the stationary core 5 of the valve housing 1 together in the process of manufacturing the electromagnetic fuel injection valve I of this type.

First of all, a jig J is prepared. This jig J is constructed by coaxially connecting a large-diameter shaft part 46 and a small-diameter shaft part 47 on an upper surface of a base 45 sequentially. The large-diameter shaft part 46 is formed so as to be tightly fitted into the inner peripheral surfaces respectively of the magnetic cylindrical body 3 and the nonmagnetic cylindrical body 4. The small-diameter shaft part 47 is formed so as to be tightly fitted into the inner peripheral surface of the stationary core 5.

This jig J is used as follows. The magnetic cylindrical body 3 is placed on the upper surface of the base 45, and the nonmagnetic cylindrical body 4 is placed on the upper end surface of the magnetic cylindrical body 3, with the magnetic cylindrical body 3 and the nonmagnetic cylindrical body 4 being sequentially and tightly fitted onto the outer peripheral surface of the large-diameter shaft part 46. In assembling, one of the tapered surfaces 4*a*, 4*a* respectively of the inner peripheral surfaces of the two ends of the nonmagnetic cylindrical body 4 guides the large-diameter shaft part 46 for smooth fitting into the inside of the nonmagnetic cylindrical body 4. Subsequently, the inner peripheral surface of the stationary core 5 is tightly fitted onto the outer peripheral surface of the small-diameter shaft part 47, while the stationary core 5 is placed on the upper end surface of the nonmagnetic cylindrical body 4.

By using the jig J in this manner, the magnetic cylindrical body 3, the nonmagnetic cylindrical body 4 and the stationary core 5 can be stacked in their axial direction while positioned coaxially. Furthermore, the annular gap G having a constant clearance throughout its entire periphery can be formed between the inner peripheral surface of the nonmagnetic cylindrical body 4 and the outer peripheral surface of the suction tubular part 5*a* of the stationary core 5 disposed inside the nonmagnetic cylindrical body 4.

Subsequently, an irradiation point of a first laser welding torch T1 is aimed at the meeting part between the magnetic cylindrical body 3 and the nonmagnetic cylindrical body 4, whereas an irradiation point of a second laser welding torch T2 is aimed at the meeting part between the nonmagnetic cylindrical body 4 and the stationary core 5. Thereafter, the base 45 is rotated around its axis while the first and second laser welding torches T1, T2 are operated. Thereby, each meeting part is welded throughout its entire periphery.

This makes it possible to liquid-tightly connect the magnetic cylindrical body 3, the nonmagnetic cylindrical body 4 and the stationary core 5 with high coaxial accuracy, and concurrently makes it possible to form the annular gap G having a constant clearance throughout its entire periphery, between the nonmagnetic cylindrical body 4 and the suction tubular part 5*a*.

For this reason, when a high-pressure fluid is supplied to the inside of the valve housing 1 to check the liquid-tightness of each of the welded parts W1, W2, W3 of the valve housing 1 after the valve housing 1 is manufactured by liquid-tightly welding the magnetic cylindrical body 3 and the valve seat member 2 together, the fluid can smoothly enter the inside, particularly the annular gap G, and thus can quickly reach the welded part W3 between the nonmagnetic cylindrical body 4 and the stationary core 5. Consequently, it is possible to check whether or not the fluid leaks from the welded part W3 almost simultaneously with the supply of the fluid. Thus, whether or not the welded part W3 is satisfactorily liquid-tight can be judged based on the presence of the fluid leak. This can greatly speed up the liquid-tightness checking process. Furthermore, because the suction tubular part 5*a* of the stationary core 5 and the movable core 17 are disposed so as to be opposed to each other in the inside of the nonmagnetic cylindrical body 4, the electromagnetic fuel injection valve I is made capable of maintaining the advantage of the reduced axial dimension of the electromagnetic fuel injection valve as in the case of the prior art.

Moreover, because, as described above, the large-diameter shaft part 46 of the jig J is tightly fitted into the inside of the nonmagnetic cylindrical body 4 with the aid of the guidance of the tapered surface 4*a* of the inner peripheral edge in an end of the nonmagnetic cylindrical body 4, it is possible to set the nonmagnetic cylindrical body 4 onto the jig J easily and quickly. Furthermore, because the tapered surface 4*a* is provided to the two end portions of the nonmagnetic cylindrical body 4, it is possible to further increase ease with which the nonmagnetic cylindrical body 4 is set onto the jig J, no matter which direction the two ends of the nonmagnetic cylindrical body face. Concurrently, the tapered surface of the inner periphery in the other end of the nonmagnetic cylindrical body is capable of receiving the fillet 5*b* around the base end of the suction tubular part 5*a* in its inside. Accordingly, it is possible to form the fillet 5*b* as a thicker member, and thus to increase the strength of the base end of the suction tubular part 5*a*.

The present invention is not limited to the above-described embodiment and may be modified in a variety of ways as long as the modifications do not depart from its gist. For example, an open limit of the valve body 16 may be restricted by directly abutting the movable core 17 against the stationary core 5.

What is claimed is:

1. An electromagnetic fuel injection valve, in which a valve housing includes: a tubular valve seat member having a valve seat in a front end portion thereof; a magnetic cylindrical body coaxially connected to a rear end portion of the valve seat member; a nonmagnetic cylindrical body coaxially and liquid-tightly welded to a rear end of the magnetic cylindrical body; and a hollow cylindrical stationary core coaxially and liquid-tightly welded to a rear end of the nonmagnetic cylindrical body, a valve assembly is housed in the valve housing and includes: a valve body capable of being seated on the valve seat; and a movable core connected to a rear end of the valve body, a suction tubular part projecting toward an inside of the nonmagnetic cylindrical body is provided to a front end portion of the stationary core, and a front end of the suction tubular part and a rear end of the movable core are opposed to each other in the inside of the nonmagnetic cylindrical body, wherein an annular gap is defined between an outer peripheral surface of the suction tubular part and an inner peripheral surface of the nonmagnetic cylindrical body, the annular gap extending uninterrupted from a point where the stationary core contacts the nonmagnetic cylindrical body to the front end of the suction tubular part, the annular gap allowing influx of a pressure fluid used for a check of liquid-tightness between the nonmagnetic cylindrical body and the stationary core.

2. A method of manufacturing an electromagnetic fuel injection valve, wherein, in welding the magnetic cylindrical body, the nonmagnetic cylindrical body and the stationary core of the electromagnetic fuel injection valve according to claim 1, a jig made by coaxially connecting a large-diameter shaft part and a small-diameter shaft part together is prepared, the large-diameter shaft part being capable of being tightly fitted into inner peripheral surfaces respectively of the magnetic cylindrical body and the nonmagnetic cylindrical body, the small-diameter shaft part being capable of being tightly fitted into an inner peripheral surface of the stationary core, and then an axial meeting part between the magnetic cylindrical body and the nonmagnetic cylindrical body as well as an axial meeting part between the nonmagnetic cylindrical body and the stationary core are welded in a state where the inner peripheral surfaces respectively of the magnetic cylindrical body and the nonmagnetic cylindrical body are tightly fitted onto an outer peripheral surface of the large-diameter shaft part of the jig, and where the inner peripheral surface of the stationary core is tightly fitted onto an outer peripheral surface of the small-diameter shaft part.

3. The method of manufacturing an electromagnetic fuel injection valve according to claim 2, wherein tapered surfaces are respectively formed in inner peripheral edge portions of two axial ends of the nonmagnetic cylindrical body, the tapered surfaces being capable of guiding the large-diameter shaft part so that the large-diameter shaft part is tightly fitted into an inside of the nonmagnetic cylindrical body.

* * * * *